US009121651B1

(12) United States Patent
Jen

(10) Patent No.: US 9,121,651 B1
(45) Date of Patent: Sep. 1, 2015

(54) AMBIDEXTROUS MAGAZINE LOCK AND RELEASE MECHANISM

(71) Applicant: Yi Huei Jen, Irvine, CA (US)

(72) Inventor: Yi Huei Jen, Irvine, CA (US)

( * ) Notice: Subject to any disclaimer, the term of this patent is extended or adjusted under 35 U.S.C. 154(b) by 0 days.

(21) Appl. No.: 14/633,862

(22) Filed: Feb. 27, 2015

(51) Int. Cl.
*F41A 17/38* (2006.01)
*F41A 9/59* (2006.01)

(52) U.S. Cl.
CPC ..... *F41A 9/59* (2013.01)

(58) Field of Classification Search
CPC ..... F41A 17/38
USPC ..... 42/6, 7, 18, 22; 89/33.1, 197
See application file for complete search history.

(56) References Cited

U.S. PATENT DOCUMENTS 4,429,479 A * 2/1984 Johnson ..... 42/6
4,713,902 A * 12/1987 Wigton ..... 42/7
5,519,954 A * 5/1996 Garrett ..... 42/6
7,596,900 B2 * 10/2009 Robinson et al. ..... 42/7
7,661,219 B1 * 2/2010 Knight et al. ..... 42/70.02
8,112,926 B2 * 2/2012 Gussalli Beretta ..... 42/7
8,166,691 B1 * 5/2012 Karfiol ..... 42/7
8,756,843 B1 * 6/2014 Cantrell ..... 42/6
8,943,866 B2 * 2/2015 Fernandez et al. ..... 70/232
8,978,282 B2 * 3/2015 Garrett ..... 42/6
9,010,004 B1 * 4/2015 Fu ..... 42/6
2006/0117634 A1 * 6/2006 Vor Keller et al. ..... 42/70.11
2006/0123683 A1 * 6/2006 Garrett et al. ..... 42/6
2010/0263252 A1 * 10/2010 Strayer ..... 42/7
2010/0281736 A1 * 11/2010 Mayberry et al. ..... 42/49.01
2012/0198742 A1 * 8/2012 Troy et al. ..... 42/6
2012/0255209 A1 * 10/2012 Klassen ..... 42/6
2013/0227869 A1 * 9/2013 Thordsen ..... 42/6
2015/0033608 A1 * 2/2015 Power ..... 42/6
2015/0068088 A1 * 3/2015 Souza ..... 42/49.02

* cited by examiner

*Primary Examiner* — Michael David

(57) ABSTRACT

A magazine lock and release mechanism for a firearm provides a left and right side magazine release, but prevents release of a magazine of a firearm without a tool. The mechanism comprises a magazine catch pivotable between an engaged and a disengaged position having a magazine catch tooth situated to engage a magazine inserted into a magazine well.

6 Claims, 6 Drawing Sheets

AMBIDEXTROUS MAGAZINE LOCK AND RELEASE MECHANISM

A magazine lock and release mechanism for a firearm provides a left and right side magazine release, but prevents release of a magazine of a firearm without a tool. The mechanism comprises a magazine catch pivotable between an engaged and a disengaged position having a magazine catch tooth situated to engage a magazine inserted into a magazine well.

BACKGROUND

The method of disengaging a magazine from a firearm varies between the different styles of firearms. Some firearm manufacturers have developed a mechanism, which is spring loaded, and typically situated on one side of the firearm and releases the magazine from the firearm. In some firearms, activation of the magazine release will disengage the magazine and the magazine will subsequently drop from the firearm due to gravity. This quick release method has prompted some lawmakers to weigh in on the safety repercussions of such quick magazine changes. Hence, lawmakers have devised a means to increase the time required to change a magazine and therefore the effectiveness of a shooter.

A magazine lock is a device that requires a shooter to utilize a tool in order to release a magazine from a firearm. The magazine lock prevents manipulation of the magazine release by a finger or fingers. This creates a situation where magazine change times are increased. The magazine lock essentially creates a situation where the magazine is considered an attached-fixed magazine. This is especially critical in the State of California where the state law requires "military-style" firearms with a detachable magazine in combination with others features to have a magazine lock equipped. The tools to be used include a bullet tip or any small object such as a screwdriver or Allen Wrench. This falls under CA Penal Code 978.20(a). Therefore, users with "military-style" firearms must have a magazine lock even at the firing range. This requires a user to utilize either of the two magazine release techniques consequently described.

In a scenario where the user is a right handed shooter and is firing a firearm equipped with a magazine lock and has now expended all their ammunition in the magazine, the user now wants to change the spent magazine to a loaded one.

One technique is to remove the hand holding the firearm grip, typically the right hand, and use a tool such as a bullet tip to enter the magazine lock mechanism and engage the magazine release. The problem with this technique is that the right hand is used to hold onto the grip of the firearm, and when removed will require the user to move the firearm away from the target. So it is imperative that the hand holding the grip is always in contact with the rifle. To eliminate this issue, some user have adopted a more time consuming, and uncomfortable technique. This technique allows the user to retain a hold on the grip while changing magazines and hence remain "locked" onto the target down-range.

This second technique adopted by some users require the use of the left hand. For this technique, the left hand is passed over or under the rifle and then the wrist is bent to position a tool in such a manner that the tool can be inserted into the magazine lock, and finally engages with the magazine release button. While this method does allow the user to remain locked onto their target, this technique is restrictive as any accessories mounted on the top of the rifle will render the over-and-in technique impossible, and using the under-and-in technique is unreliable as the user cannot always see the magazine lock hole and might miss the magazine release button. This further increases the time requirement of releasing a magazine in the first place.

Finally, any left handed shooter can attest that the magazine lock is especially frustrating, as many manufacturers focus their designs on the larger portion right handed shooters. Hence, magazine lock mechanisms are very common for right handed shooters and rare for left handed shooters. Furthermore, once installed on a particular side, a shooter with the opposite dominant hand cannot easily use the weapon.

Therefore, there is an apparent need for a magazine release mechanism that will be operable from both the left side and the right side of the firearm, does not require a user to remove their hand from the rifle grip, and requires a tool, to release the magazine.

FIELD OF INVENTION

The invention generally relates to a magazine lock and release mechanism. More specifically, this invention relates to an apparatus that will allow a user to release a magazine without removing their hand from the rifle grip. Furthermore, the invention aims to provide an apparatus by which a magazine can only be released on either side of the firearm by engagement of the mechanism by a tool.

SUMMARY OF INVENTION

It is a primary feature of the present invention to provide an ambidextrous magazine lock and release mechanism for a firearm having a magazine well configured to operatively engage a magazine with a side-locking slot. It is another feature of the present invention to provide an ambidextrous magazine lock and release mechanism, to also be referred to a ambi bullet button, which disables the release of a magazine from the magazine well without utilization of a tool. The mechanism comprises a magazine catch pivotable between an engaged and a disengaged position having a catch tooth configured to engage the side-locking slot of a magazine inserted into the magazine well when the magazine catch is in the engaged position, and to miss the side-locking slot when the magazine catch is in the disengaged position. The mechanism is provided on the firearm comprising a pushbutton affixed to a bar providing a push surface on one side of the firearm and the bar extending to an interface on the opposing side of the firearm which provides another push surface by which a magazine catch is operatively pivotable between the engaged and the disengaged position.

In one embodiment of the invention, a magazine release mechanism is provided so that a magazine inserted into the firearm can only be released from the magazine well by utilization of a tool. In another embodiment, means for pivoting the magazine catch is provided. Such an embodiment includes a bar with a push surface on one end and an opposing end with a pin hole configured to receive a lock pin. Such an embodiment further includes a magazine catch cover secured by roll pins at a linkage bracket, and an engagement hole by which the magazine catch can be pivoted between the engaged and the disengaged position.

These and other features, aspects and advantages of the present invention will become better understood with reference to the following drawings, descriptions and claims.

CLAIMS

1. A magazine lock and release mechanism for a firearm, the mechanism being operable from either side of the firearm and comprising:

a bar having first and second ends and extending between each side of the firearm, the bar being longitudinally slidable within the firearm between a depressed and a normal position;

a pushbutton cover positioned around the second end of the bar;

a spring for biasing the second end of the bar towards the pushbutton cover;

a pushbutton attached to the second end of the bar for pushing the spring against the pushbutton cover;

a magazine catch pivotally connected to the first end of the bar and comprising a tooth on the inner surface of one end of the magazine catch and a push surface on the outer surface of the end opposite the tooth, the magazine catch positioned to pivot between an engaged and a disengaged position;

a linkage bracket having an insertion end and a connection end;

a catch cover connected to the connection end of the linkage bracket and comprising a top, bottom, front, and side surfaces for concealing the magazine catch, the front surface being defined by a hole therethrough a section of the magazine catch push surface is exposed;

wherein said mechanism is used to lock and prevent release of a magazine without a tool.

2. A mechanism according to claim 1, wherein the bar, pushbutton and pushbutton cover are organized such that the pushbutton cannot be engaged by a finger.

3. A mechanism according to claim 1, wherein the magazine catch and magazine catch cover are organized such that the push surface cannot be engaged by a finger.

4. A firearm for use with a magazine, the firearm comprising:

a body having a magazine well configured to accept a magazine; and magazine lock and release mechanism for a firearm, the mechanism being operable from either side of the firearm and comprising:

a bar having first and second ends and extending between each side of the firearm, the bar being longitudinally slidable within the firearm between a depressed and a normal position;

a pushbutton cover positioned around the second end of the bar;

a spring for biasing the second end of the bar towards the pushbutton cover;

a pushbutton attached to the second end of the bar for pushing the spring against the pushbutton cover; and a magazine catch pivotally connected to the first end of the bar and comprising a tooth on the inner surface of one end of the magazine catch and a push surface on the outer surface of the end opposite the tooth, the magazine catch positioned to pivot between an engaged and a disengaged position;

a linkage bracket having an insertion end and a connection end;

a catch cover connected to the connection end of the linkage bracket and comprising a top, bottom, front, and side surfaces for concealing the magazine catch, the front surface being defined by a hole therethrough a section of the magazine catch push surface is exposed;

wherein said mechanism is used to lock and prevent release of a magazine without a tool.

5. A mechanism according to claim 4, wherein the bar, pushbutton and pushbutton cover are organized such that the pushbutton cannot be engaged by a finger.

6. A mechanism according to claim 4, wherein the magazine catch and magazine catch cover are organized such that the push surface cannot be engaged by a finger

DESCRIPTION OF DRAWINGS

Brief Description

The following descriptions are set forth and have been assigned numerical designations to enable the reader to understand the reasoning behind and the application of the present invention. While the preferred embodiment of the present invention is aimed at an ambidextrous magazine lock and release mechanism, showing an AR rifle upper receiver, the invention is applicable to other firearms featuring a similar magazine release mechanism.

FIG. 10 (*b*) is another illustration of the nut cover, a component of the present invention.

DETAILED DESCRIPTION

Figure 1:
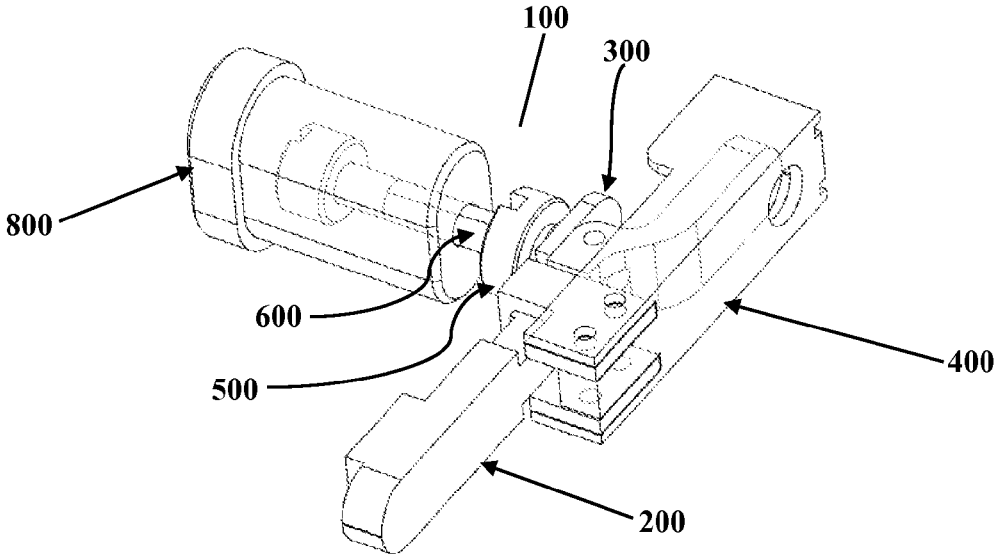
FIG. 1 is an illustration of the present invention, ambidextrous magazine lock and release mechanism, with transparent outer surfaces.

FIG. 1 is an illustration of the present invention, ambidextrous magazine lock and release mechanism 100, with transparent outer surfaces. Each component is discussed in further detail subsequently. Transparent outer surfaces are used to provide a clearer illustration of the internal configuration of the invention.

Figure 2:
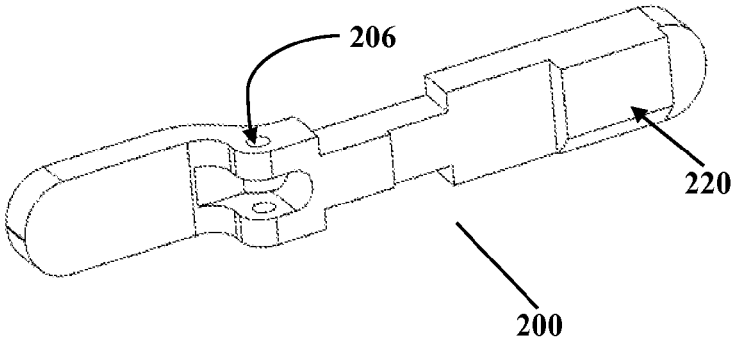
FIG. 2 is an illustration of a magazine catch, a component of the present invention.
Figure 3:
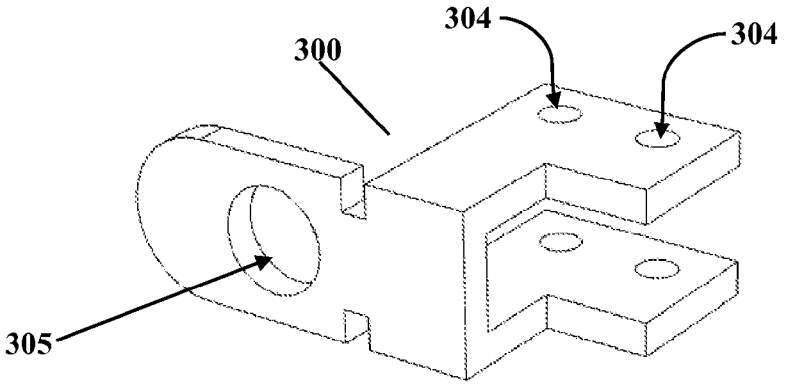
FIG. 3 is an illustration of a linkage bracket, a component of the present invention.
Figure 4:
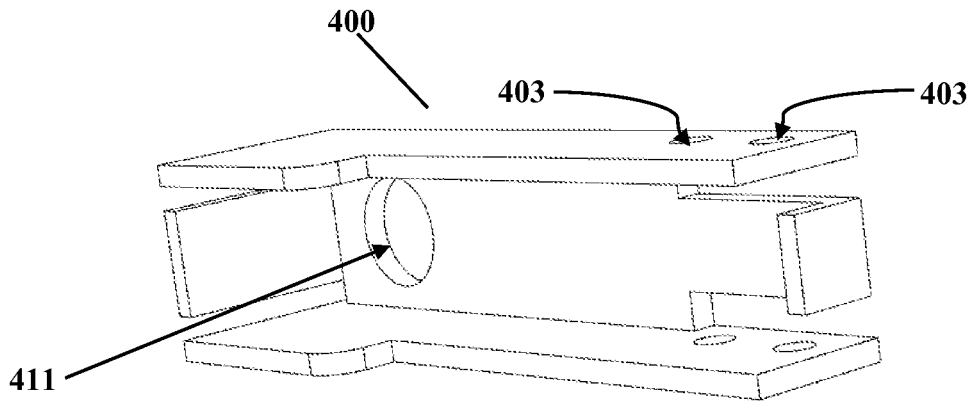
FIG. 4 is an illustration of a catch cover, a component of the present invention.
Figure 5:
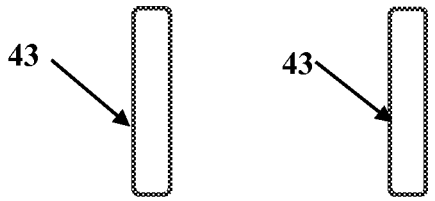
FIG. 5 is an illustration of cover roll pins, a component of the present invention.

FIG. 2 is an illustration of a magazine catch 200, a component of the present invention 100. Catch tooth 220 which engages and secures a magazine inserted into the magazine well of a firearm is shown. Catch pin hole 206 is also shown and provides means for a roll pin to be inserted. FIG. 3 is an illustration of a linkage bracket 300, a component of the present invention 100. A threaded bracket bar hole 305 is shown along with two bracket pin holes 304. Bracket bar hole 305 provides a means for a bar to be inserted through the hole and position at the aforementioned magazine catch 200. Bracket pin holes 304 provides a means for a pin to be inserted into each hole and through to the catch cover 400 as shown in FIG. 4. The catch cover 400 is secured via pins inserted through the bracket pin holes 304 and into the cover pin holes 403. In FIG. 4, catch cover 400 also features the first engagement hole 411 which provides a means for a tool to release a magazine. FIG. 5 is an illustration of the cover roll pins 43 providing securement between linkage bracket 300 and catch cover 400 together via insertion into the bracket pin holes 304 and cover pin holes 403.

Figure 6:
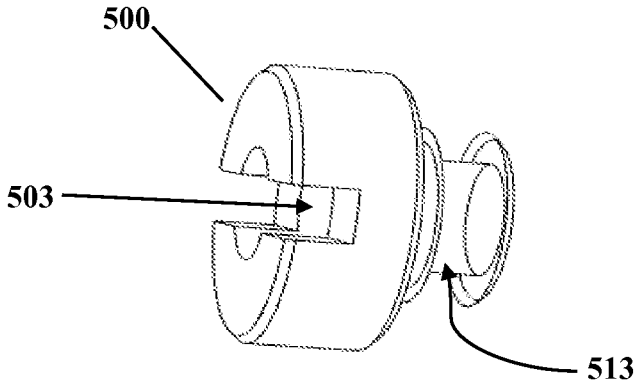
FIG. 6 is an illustration of a linkage nut, a component of the present invention.
Figure 7:
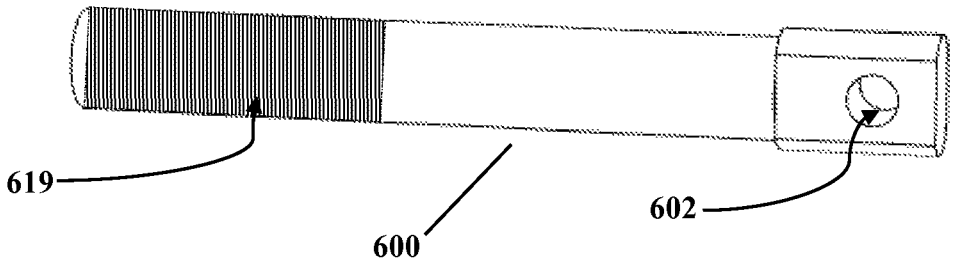
FIG. 7 is an illustration of a bar, a component of the present invention.
Figure 8:
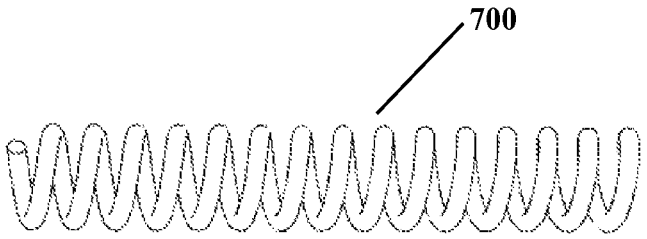
FIG. 8 is an illustration of a spring, a component of the present invention.
Figure 9:
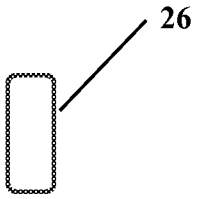
FIG. 9 is an illustration of a catch roll pin, a component of the present invention.
Figure 11:
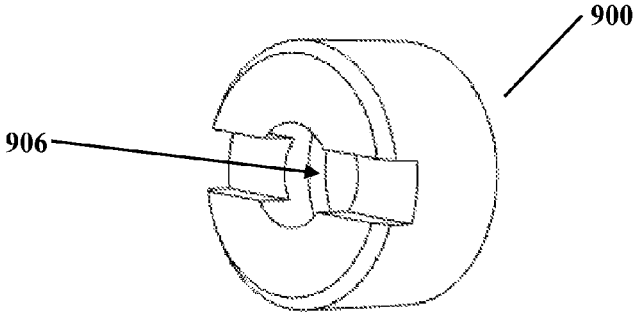
FIG. 11 is an illustration of a push nut, a component of the present invention.

FIG. 6 is an illustration of a linkage nut 500, a component of the present invention 100. Linkage nut 500 comprises a nut shaft 513 with a threaded outer surface, and a nut bar hole 503 which allows a bar 600 shown in FIG. 7 to enter and position a bar pin hole 602 in a position which allows a pin to be inserted through the aforementioned catch pin hole 206 from FIG. 2 into and through the bar pin hole 602. A threadable section 619 which begins at the end of the bar 600 opposite the bar pin hole 602 is also shown and provides a means for attachment of a push nut 900 described in subsequent FIG. 11. FIG. 8 is an illustration of a spring 700, a component of the present invention 100, which has an inner diameter large enough to allow it to slide over the threaded portion of the bar 619, but small enough to be stopped before the bar pin hole 602. FIG. 9 is an illustration of the catch roll pin 26, a component of the present invention 100. The catch roll pin 26 is provided to pivotally secure the bar 600, at bar pin hole 602, to the magazine catch 200, at catch pin hole 206.

Figure 10A:
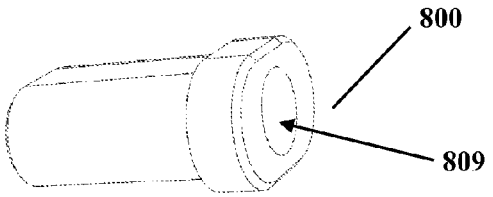
FIG. 10 (*a*) is an illustration of a nut cover, a component of the present invention.
Figure 10B:
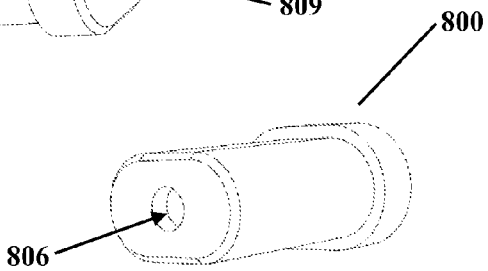

FIG. 10 (*a*) is an illustration of a nut cover 800, a component of the present invention 100. Nut cover 800 feature a nut cover hole 809 that allows the push nut 900 to be inserted into one end and secured by engagement of the threaded portion of the bar 619 and the push nut 900. FIG. 10 (*b*) is another illustration of the nut cover 800, a component of the present invention 100 showing the side opposite the nut cover hole 809. Push bar hole 806 provides a means for the threadable portion of the bar 619 to be secured via a second engagement hole 906.

Figure 12:
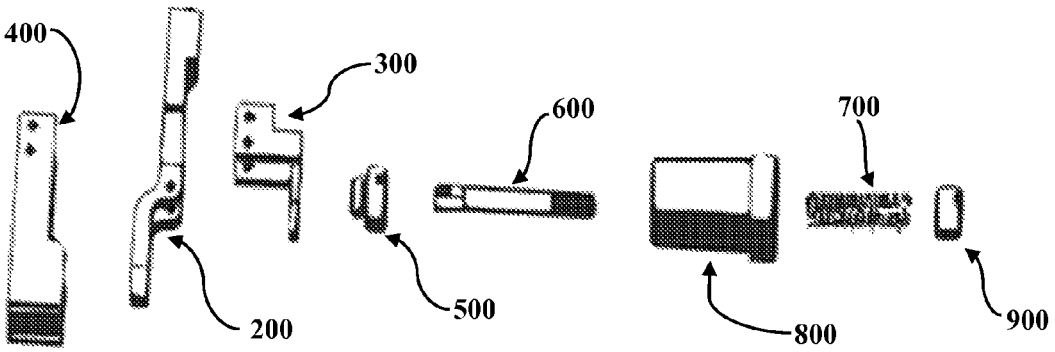
FIG. 12 is an exploded view of the sequence for installation of the present invention.

FIG. 12 is an exploded view of the sequence for installation of the present invention 100. As shown, magazine catch 200 is secured by pins inserted into linkage bracket 300 and magazine catch cover 400. Subsequently, linkage nut 500 is threadably attached to the linkage bracket 300. Bar 600 and magazine catch 200 are then secured via a roll pin. Nut cover 800 is then slid over bar 600 which allows spring 700 to then slide over the bar 600, and compressed to screw push nut 900 onto the bar 600.

Figure 13:
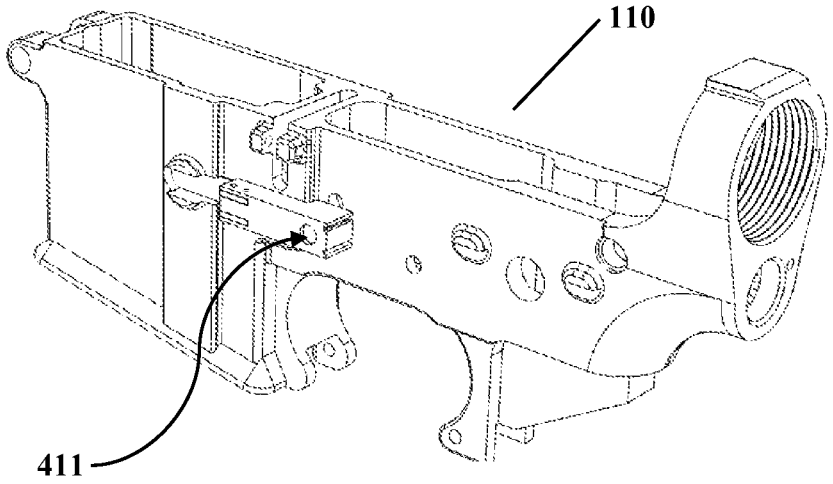
FIG. 13 is an illustration of the left side of a rifle upper receiver with the present invention installed.
Figure 14:
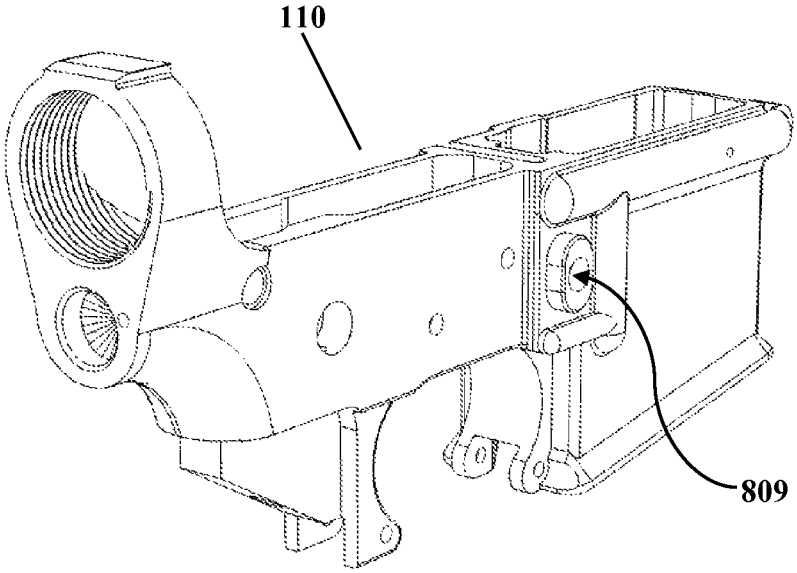
FIG. 14 is an illustration of the right side of a rifle upper receiver with the present invention installed.

FIG. 13 is an illustration of the left side of the rifle upper receiver 110 with the present invention 100 installed. As shown, first engagement hole 411 is features. Similarly, FIG. 14 is an illustration of the right side of the rifle upper receiver 110 with the present invention 100 installed. The second engagement hole 809 is featured in this figure.

Figure 15:
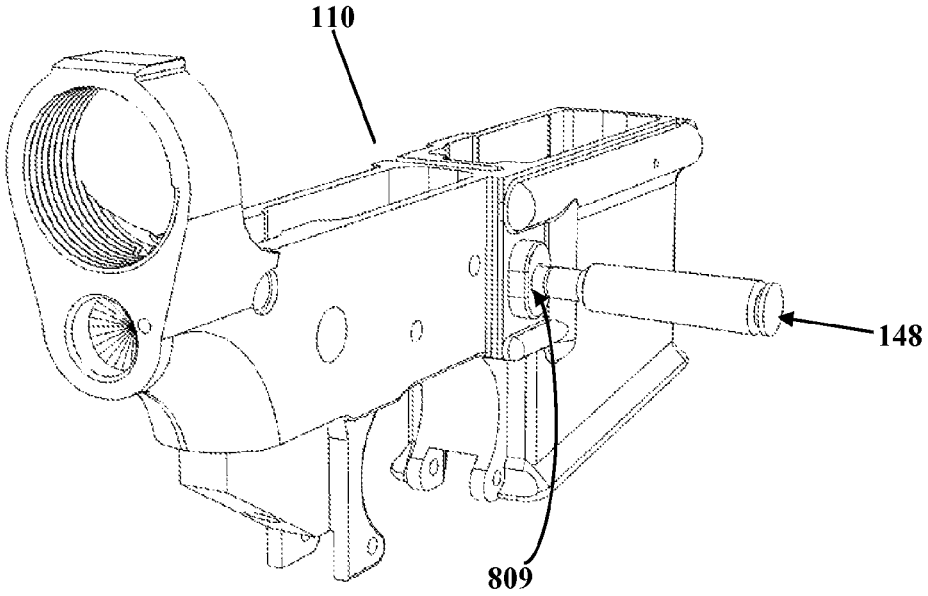
FIG. 15 is an illustration of the right side of a rifle upper receiver with the present invention installed and a tool for magazine release in engagement.
Figure 16:
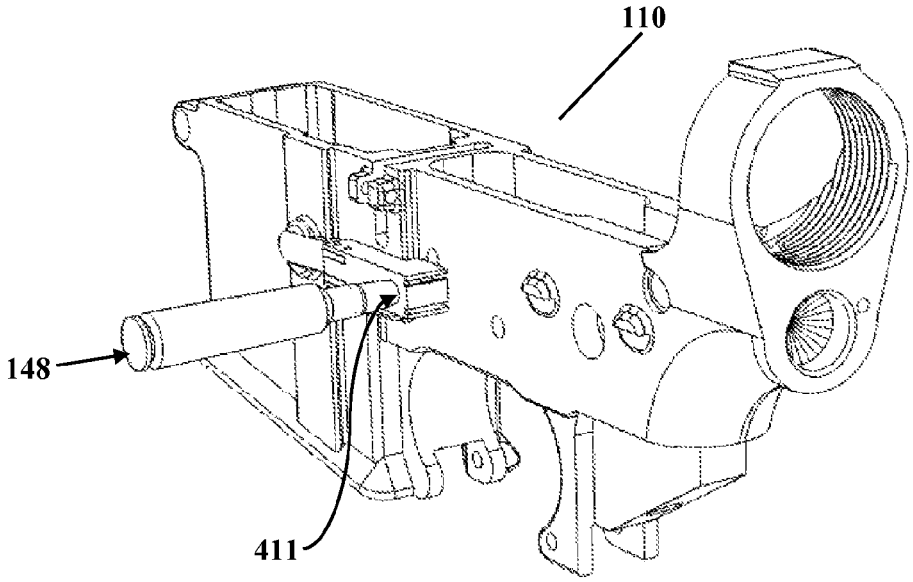
FIG. 16 is an illustration of the left side of a rifle upper receiver with the present invention installed and a tool for magazine release in engagement.

FIG. 15 is an illustration of the right side of a rifle upper receiver 110 with the present invention 100 installed, and a tool 148 for magazine release in contact with the second engagement hole 809. FIG. 16 is an illustration of the left side of a rifle upper receiver 110 with the present invention 100 installed and a tool 148 for magazine release in contact with the first engagement hole 411.

The invention claimed is:

1. A magazine lock and release mechanism for a firearm, the mechanism being operable from either side of the firearm and comprising:

a bar having first and second ends and extending between each side of the firearm, the bar being longitudinally slidable within the firearm between a depressed and a normal position;

a pushbutton cover positioned around the second end of the bar;

a spring for biasing the second end of the bar towards the pushbutton cover;

a pushbutton attached to the second end of the bar for pushing the spring against the pushbutton cover;

a magazine catch pivotally connected to the first end of the bar and comprising a tooth on the inner surface of one end of the magazine catch and a push surface on the outer surface of the end opposite the tooth, the magazine catch positioned to pivot between an engaged and a disengaged position;

a linkage bracket having an insertion end and a connection end;

a catch cover connected to the connection end of the linkage bracket and comprising a top, bottom, front, and side surfaces for concealing the magazine catch, the front surface being defined by a hole therethrough a section of the magazine catch push surface is exposed;

wherein said mechanism is used to lock and prevent release of a magazine without a tool.

2. A mechanism according to claim 1, wherein the bar, pushbutton and pushbutton cover are organized such that the pushbutton cannot be engaged by a finger.

3. A mechanism according to claim 1, wherein the magazine catch and magazine catch cover are organized such that the push surface cannot be engaged by a finger.

4. A firearm for use with a magazine, the firearm comprising:

a body having a magazine well configured to accept a magazine; and magazine lock and release mechanism for a firearm, the mechanism being operable from either side of the firearm and comprising:

a bar having first and second ends and extending between each side of the firearm, the bar being longitudinally slidable within the firearm between a depressed and a normal position;

a pushbutton cover positioned around the second end of the bar;

a spring for biasing the second end of the bar towards the pushbutton cover;

a pushbutton attached to the second end of the bar for pushing the spring against the pushbutton cover; and a magazine catch pivotally connected to the first end of the bar and comprising a tooth on the inner surface of one end of the magazine catch and a push surface on the outer surface of the end opposite the tooth, the magazine catch positioned to pivot between an engaged and a disengaged position;

a linkage bracket having an insertion end and a connection end;

a catch cover connected to the connection end of the linkage bracket and comprising a top, bottom, front, and side surfaces for concealing the magazine catch, the front surface being defined by a hole therethrough a section of the magazine catch push surface is exposed;

wherein said mechanism is used to lock and prevent release of a magazine without a tool.

5. A mechanism according to claim 4, wherein the bar, pushbutton and pushbutton cover are organized such that the pushbutton cannot be engaged by a finger.

6. A mechanism according to claim 4, wherein the magazine catch and magazine catch cover are organized such that the push surface cannot be engaged by a finger.

* * * * *